US005615481A

United States Patent [19]

Viegener et al.

[11] Patent Number: 5,615,481

[45] Date of Patent: Apr. 1, 1997

[54] METHOD AND APPARATUS FOR THE PRODUCTION OF CIRCUMFERENTIALLY COMPRESSIBLE PIPE FITTINGS

[75] Inventors: Walter Viegener, Attendorn-Biekhofen; Heinz Walter, Renningen; Wolfgang Grau, Böblingen, all of Germany

[73] Assignee: Witzig & Frank Turmatic GmbH, Offenburg, Germany

[21] Appl. No.: 326,770

[22] Filed: Oct. 20, 1994

[30] Foreign Application Priority Data

Oct. 23, 1993 [DE] Germany ..... 43 36 261.3
Mar. 24, 1994 [DE] Germany ..... 44 10 146.5

[51] Int. Cl.[6] ..... B21D 39/00; B23P 11/00

[52] U.S. Cl. ..... 29/890.149; 29/237; 29/243.518; 29/243.519; 29/890.148; 285/179; 285/382.4; 285/382.5

[58] Field of Search ..... 285/179, 382.4, 285/382.5; 29/890.149, 890.148

[56] References Cited

U.S. PATENT DOCUMENTS 1,801,171 4/1931 Mueller et al. ..... 29/890.149 X
1,817,854 8/1931 Sorensen .
2,427,026 9/1947 Smith .
3,220,098 11/1965 Arbogast .
3,596,939 8/1971 Gibson ..... 285/179 X

FOREIGN PATENT DOCUMENTS 1496155 9/1967 France .
801888 1/1951 Germany ..... 285/382.5
3124957 1/1983 Germany .
415013 11/1932 United Kingdom ..... 285/382.5
570093 6/1945 United Kingdom .

*Primary Examiner*—Carl J. Arbes
*Attorney, Agent, or Firm*—Frishauf, Holtz, Goodman, Langer & Chick, P.C.

[57] ABSTRACT

To form a pipe fitting (90) having a body (92) formed with at least one outer bulge (93) defining an inner circumferential groove (93*a*), in which a sealing ring (93*b*) can be located, so that the fitting, upon circumferential compression, can sealingly engage a pipe (91) inserted therein, a blank (11) is inserted into a two-part die, joined together at a severing plane. The die is formed with an annular recess or groove (7, 8). A mandrel is inserted in the pipe to maintain its inner diameter, and an upset member is forcibly moved against the end portions of the blank. The material of the blank (11) will flow into the annular groove (7, 8), thus forming the circumferential bulge (93). To accurately dimension and shape the resulting inner groove (93*a*), a roller element is inserted into the pipe, and rotated about itself, and additionally moved in an orbital or spiral path against the inner wall of the initially formed groove, to define its shape and size. The die may be formed with a part-annular groove at the end and the upset member may carry an outer matrix portion formed with the remaining part of the annular groove at the end portion, and further carrying at least part of the mandrel, so that, in one operation, the mandrel enters the pipe, and completes the die into which the material can flow upon upsetting. This permits rapid, inexpensive mass production of flowable material for the fitting, such as copper, brass, bronze, or the like.

19 Claims, 7 Drawing Sheets

METHOD AND APPARATUS FOR THE PRODUCTION OF CIRCUMFERENTIALLY COMPRESSIBLE PIPE FITTINGS

FIELD OF THE INVENTION

The present invention relates to circumferentially compressible compression or press pipe fittings, for connecting tubes or pipes with each other, or with other piping elements. The pipe fittings are made of a material that can be deformed, for example copper or steel.

BACKGROUND

The pipe fitting is intended to be slipped over the end of a pipe to which it is to be connected, preferably with the interposition of a sealing ring, such as an O-ring. The fitting is then circumferentially squeezed or compressed from the outside to form a tight joint with the inwardly located pipe element. This circumferential compression can be done, for example, by compression jaws, rolling, or the like.

The pipe fitting must be formed with an inner groove in order to accommodate the sealing element, typically the O-ring. This requires deformation of the material of the pipe fitting. The deformation must not weaken the material of the fitting because, otherwise, leakage or other damage might result. It is, therefore, desirable that the pipe fitting fits the respective pipe ends, with which it is to be used, as accurately as possible before compression, so that excessive deformation of the pipe fitting when placed in use is not required.

Compression pipe fittings of this type are used in large numbers for installations of piping systems. Typically, these fittings are used for water pipes in a wide variety of sizes, for example from fractional inch sizes on up. A large number of such fittings are used, and thus it should be possible to make them at low cost.

The pipe and pipe fittings should, preferably, be of the same material so that the materials do not have different electrochemical potentials, resulting in possible corrosion at their juncture.

The circumferentially compressible pipe fitting has a tube-shaped connecting portion which receives an end of the pipe with which it is to be connected. This connecting portion has an outwardly bulged portion, defining an inner circumferential recess. The circumferential recess receives a sealing element, such as the O-ring, to effect a tight sealing connection between the pipe fitting and the connecting pipe, once the pipe fitting is circumferentially squeezed about the pipe. Typically, the connecting pipe is of sturdy material and, itself, not readily deformable, e.g. standard copper, brass, steel, black-iron, or other types of piping material.

THE INVENTION

It is an object to provide a method, and an apparatus, to make circumferentially compressible pipe fittings of excellent quality, of high reproducibility and good accuracy, and low tolerances, rapidly and economically. The method and apparatus should be suitable for use with various materials, such as copper, brass, steel, or the like.

Briefly, in accordance with a feature of the invention, the pipe fitting is received in a die, which supports and holds the blank. The manufacturing process has two major steps. In the first of these major steps, the connecting portion of the pipe fitting is upset into grooves formed in the die to obtain an outwardly bulged portion, the inside of which will be a circumferential recess, which, later on, can receive the sealing element, typically the O-ring. During this step, a support mandrel is located inside the connecting portion and prevents the connecting portion from decreasing the inner diameter of its opening.

The second one of the major steps includes, after the support mandrel has been removed, rolling of the inner circumferential recess in the recess inside of the bulge, to its precise form and dimension.

In accordance with a feature of the invention, the connecting portion of the pipe fitting is supported both on its outside as well as on its inside during the upsetting operation. Thus, the wall thickness of the connecting portion of the pipe fitting cannot increase materially, so that the inner and outer diameters of the pipe fitting, outside of the region of the bulge, remain essentially unchanged. During the upsetting process, material flows into the annular recess of the die. This recess can be provided entirely inside the die, or defined between a fixed die part and a die element coupled to an upsetting member, such as a punch or stamping head. This process step ensures that there is enough material in the bulge subsequent to the bulge-forming process available for the next major step, which is the rolling step. Therefore, the wall thickness of the outwardly bulged portion defining the inner circumferential recess can be as large as the wall thickness of the connecting portion. This ensures that the pipe fitting is not weakened in the zone of the bulge portion. This zone is particularly subject to stress when the fitting is in use. The bulge portion does not form a weakened part of the pipe fitting and, therefore, tightness of the joint and a long lifetime can be expected.

The pipe fitting provides a secure connection even if there are considerable axial forces, for example caused by expansion due to heating of the pipe connected by the pipe fitting. Thus, it is possible to connect copper tubings by copper compression fittings. Such pipes may elongate considerably upon heating; the coefficient of expansion of copper is 50% higher than that of steel. The pipe fittings can be made of copper, and eliminate use of other materials which, with copper, react to cause corrosion due to electrolytic reactions.

The manufacturing process can readily be automated and carried out by automatic machinery, and thus carried out at low cost.

The blank can be cut to size at the connecting portion which is upset in the die. Tolerances which might otherwise affect the final fitting, and which would influence the forces arising during upsetting of the blank, and the resulting wall thicknesses in the zone of the bulge portion, can be eliminated.

A roller is preferably used to form the inner circumferential recess in the bulge. The wall thickness may be slightly enhanced in the zone of the bulge after the upsetting process. The roller is eccentrically guided within the pipe connection portion in the region of the bulge, and rolls the upset wall material into the ring-groove like recess of the die, so that a smooth, circumferentially accurate bulge with accurate inner and outer surfaces is formed. The shape of the roll defines the shape of the surface at the inner circumference of the groove, and thus this shape can be matched to the cross-sectional shape of an O-ring acting as a seal. The shape, typically generally essentially semi-circular, can easily be obtained, with low tolerances.

The roller is guided eccentrically, to move in an orbital path while rotating about its own axis. This orbital path can increase in diameter, so that the roller can start operation concentrically with the axis of the fitting, and then, in a spiral path with gradual increasing spiral diameter, engage the bulged, previously upset portion more and more, until the final dimension of the groove in the upset portion has been rolled into the fitting. During the entire rolling operation, the fitting is retained in the die, so that the outer dimension and shape of the fitting is accurately maintained.

The support at the outside of the fitting during the rolling process may be enhanced by an additional matrix member. The die, or the die in common with the matrix member, defines the groove which determines the outer shape of the bulged portion in the fitting.

In a first embodiment of the apparatus, the upset member is a sleeve which can enter the opening provided in the die. An annular groove is provided within the opening for receiving the bulging portion during the upsetting process. The support mandrel prevents material from bulging inwardly so that the opening of the fitting is kept clear with the proper diameter. The advantage of this embodiment is that the apparatus can be designed relatively simply. This is especially true because the same die can be used for the upsetting step and for the rolling step in which the inner circumferential recess is formed.

Another embodiment of the apparatus of the invention uses a die having a matrix portion with an annular groove which is located at the orifice of the opening provided in the die. The upset member, which is coupled to the matrix portion, is likewise provided with an annular groove that faces the die. Both annular grooves together, i.e. the groove provided at the upset member and the groove provided at the matrix portion form, in common, the groove which results in the outwardly bulged portion of the fitting. A support mandrel, adapted to prevent upset material from entering the opening of the connecting portion of the pipe fitting, can be located in the matrix portion. An advantage of this embodiment of the apparatus is that, at the beginning of the upset process, a wide gap between the upset member and the matrix portion exists, in which gap a relatively large portion of the blank can bulge outwardly.

During the radial rolling step, an additional matrix portion is preferably used which can be fixedly secured on the die.

DRAWINGS

DETAILED DESCRIPTION

Figure 9:
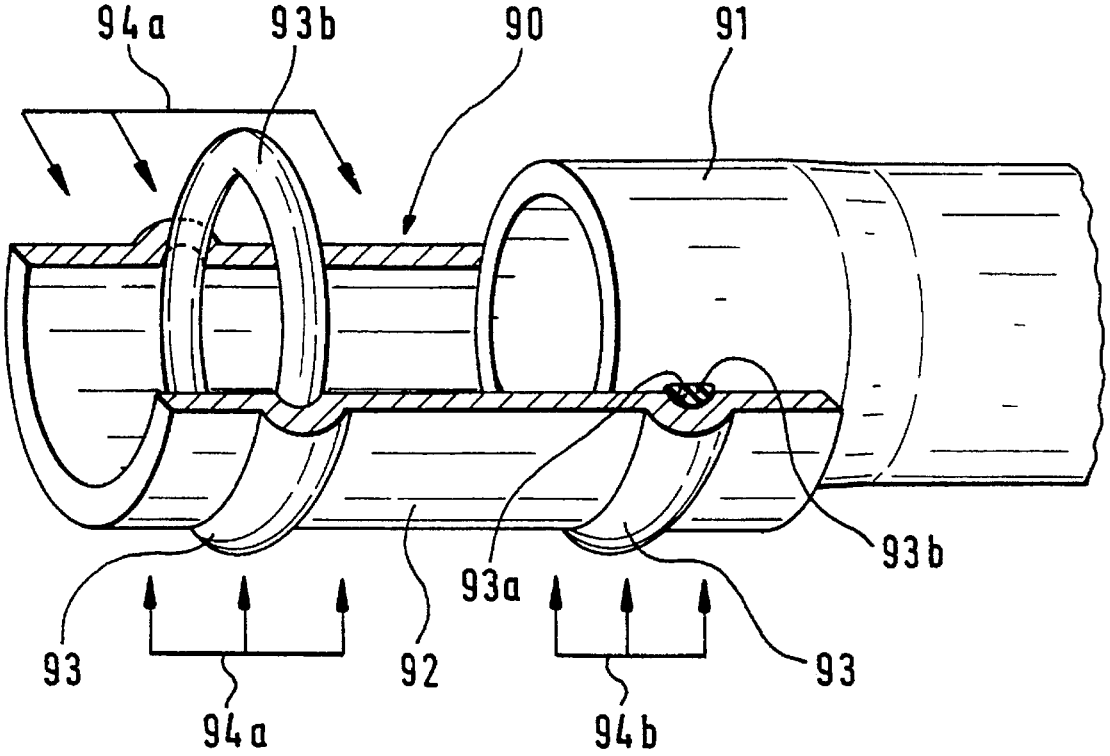
Fig. 9 PRIOR ART
FIG. 9 is a schematic view, partly broken away, of a pipe end inserted in the fitting made by the process and apparatus in accordance with the present invention. The fitting, itself, is known.

Referring first to FIG. 9: The pipe fitting 90 is intended to be placed around a pipe end or pipe stub 91. A similar stub 91, omitted from FIG. 9, can be inserted into the other end of the pipe fitting. The two pipes may abut each other or can be spaced from each other by any desired, usually small, distance. The pipe fitting 90 has a generally cylindrical body 92, the inner diameter of which is matched closely to the outer diameter of the pipe or pipes 91 which it is to receive.

The body 92 of the pipe fitting is formed with two bulges 93, which define inner grooves **93*a* in which sealing rings 93*b*, typically O-rings, are located. After insertion of the pipe or pipes 91 into the fitting, with the O-rings installed, circumferential pressure as schematically indicated by arrows 94*a*, 94*b* is applied against the outside of the fitting so that the fitting is tightly squeezed or compressed around the pipe or pipes 91**. The cross section of the O-ring may deform in this step.

As can be readily seen from FIG. 9, it is important that the wall thickness of the body 92 of the pipe fitting 90 be as uniform as possible throughout its entire extent, and that no weakened regions in the areas around the bulges 93 should occur.

The invention will first be described with respect to a 90° elbow fitting. Of course, the shape of the fitting can be as desired, in dependence on its ultimate use.

Figure 1:
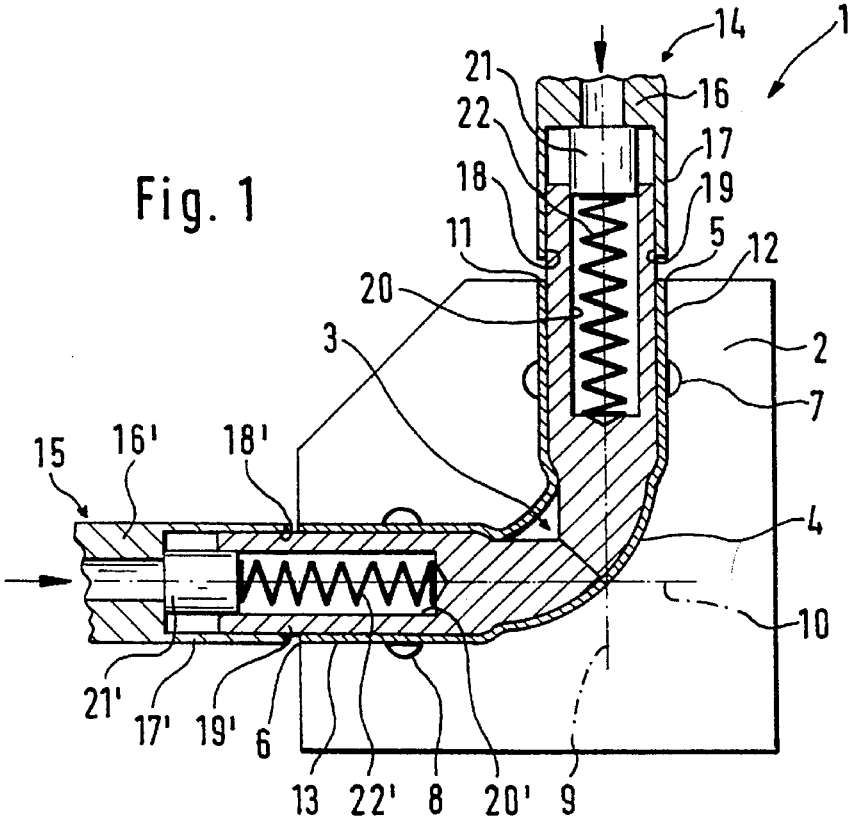
FIG. 1 is a schematic sectional view, partially broken away, of an apparatus for accomplishing a first production step for manufacturing of press pipe fittings.

Referring now to FIG. 1:

The apparatus 1 for manufacturing of an angle or elbow fitting comprises a two-part die. Only one part, part 2, of the die is illustrated schematically in the drawing. The other part is mirror-symmetrical with respect to the part 2 which is shown. After insertion of a blank 11 into part 2, and assembly with its mirror-symmetrical part, the parts are securely attached together by any suitable device, for example by threaded bolts, clamps or the like.

The die part 2 is formed with a cavity 3 having a shape of the desired outer shape of the pipe fitting that is to be produced, with low tolerances. The die is for a pipe fitting defining a right angle; the cavity 3 thus has the shape of a right-angled compression pipe fitting, which shape is defined by two cylindrical bores 5, 6 which are arranged in a right angle to each other and connected by means of a bent duct 4. Each bore 5, 6 is formed with an annular recess 7, 8 which is arranged at a distance of between several millimeters to centimeters from the orifice of the respective bore 5, 6. The annular recesses 7, 8 are arranged coaxially to the respective axes of the bores 5, 6.

A blank 11 is inserted into the cavity 3 by splitting part 2 and its mirror image part from which the desired pipe fitting is made. The blank 11 has such dimensions that it fits into the cavity 3, so that the blank lies within the die without play. Portions of the blank 11 which lie within the bores 5, 6 form pipe connecting portions 12, 13 which have a hollow cylindrical shape. They do not yet enter the annular grooves 7, 8, which means that they have no bulges yet.

The apparatus 1 comprises two identical upsetting devices 14, 15. Only the upsetting device 14 will be described, that is, the upper one of FIG. 1. The same reference numbers are used for same parts of the upsetting device 15.

The upset device 14 (or 15) has a plunger 16 which is suitably mounted on an apparatus for moving the plunger in an axial direction. A hollow cylindrical part of the plunger 16 which forms an upset sleeve 17 is provided on the plunger 16 and faces the die. The outer diameter of the upset sleeve 17 equals the inner diameter of the bore 5 so that the upset sleeve 17 fits with a very low clearance into the bore 5 without forming a considerable gap.

The hollow-cylindrical upset sleeve 17 is open on its side that faces the die 2, so that an opening 18 is formed on this side. A support mandrel 19 is slidably received in the opening 18. The support mandrel is formed essentially cylindrically. It projects beyond the opening 18 so far that it fills and supports the pipe connecting portion 12 of the blank 11 even before the upset sleeve abuts with the end face of the pipe connecting portion 12. Furthermore, the support mandrel 19 is adapted to the shape of the bent duct 4 of the die 2 on its tip. An abutment face is provided at the tip of the support mandrel 19 by means of which the support mandrel engages the support mandrel 19' in portion 13 of the blank 11.

The support mandrel 19 has a blind bore 20 which opens at an end of the support mandrel that is located within the upset sleeve. A guide piece 21 is located within the blind bore 20 at the end portion thereof and is connected with the plunger 16. A coil spring 22 is located between the guide piece 21 and the bottom of the blind bore 20. The coil spring urges the support mandrel 19 to project from the opening 18 of plunger 16 as far as possible. A suitable element, e.g. a C-ring (not shown), prevents the support mandrel 19 from slipping out of the upset sleeve 17.

Figure 3:
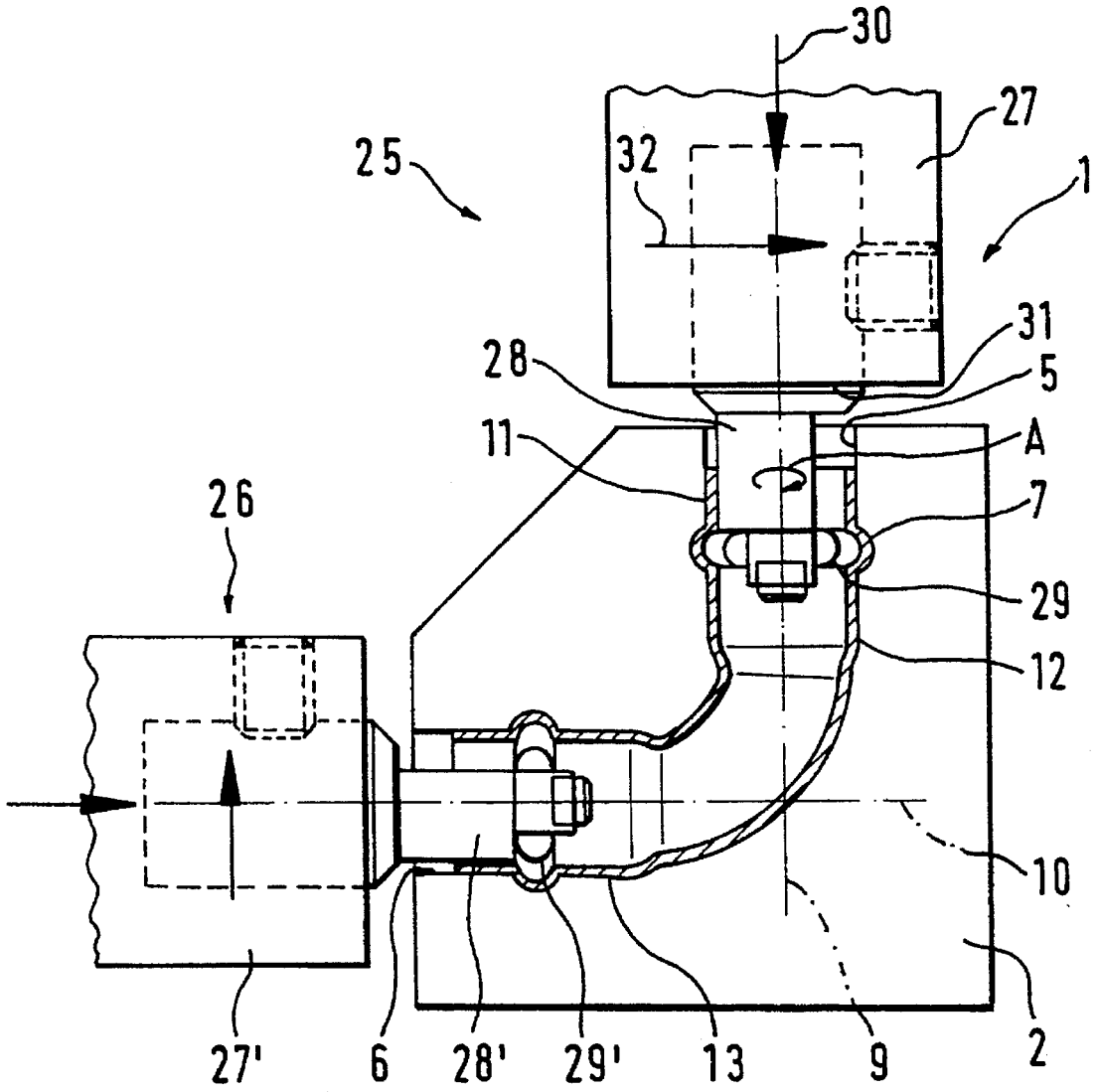
FIG. 3 is a schematic partial illustration of the apparatus of FIGS. 1 and 2, performing a further production step.

FIG. 3 shows two roll devices 25, 26 of the apparatus 1 which are not shown in FIG. 1. The roll device 25 is associated with the bore 5 of the die, and the roll device 26 is associated with the bore 6. Both roll devices 25 and 26 are identical and differ only in the spatial arrangement thereof. Therefore, only the roll device 25 is described hereinafter, and parts of the roll device 26 are referred with the same reference numerals as parts of the roll device 25 marked with prime notation.

The roll device 25 comprises a base body 27 which is mounted on a guide and moving assembly. A carrier element 28 projects from the base body 27 in the direction of the bore axis 9. The element 28 has an outer diameter, which is considerably smaller than the diameter of the bore 5, and has a length that exceeds the distance between the annular groove 7 and the orifice of the bore 5. A roller or wheel 29 is rotatably mounted at the end of the carrier which is located within the bore 5 and which is, in FIG. 3, the bottom end of the support carrier 28. The diameter of the roller 29 is smaller than the inner diameter of the pipe connecting portion 12 of the blank 11. The cross-sectional shape of the outside of the roller 29 is generally bell-shaped. The roller 29 defines a gap with the annular recess 7, which gap has a uniform thickness when the roller 29 is located properly within the annular groove 7.

The base body 27 is, driven from the guiding and moving assembly, movable in the direction of arrow 30, which means axially in the direction of the bore axis 9. A rotation-imparting device 31 is provided within the base body 27, which device 31 rotates the roller 29 about its axis, see arrow A. In addition, the carrier 28 can move in the guiding and moving assembly to move the axis of rotation A of the roller 29 in a radial direction, namely in the direction of arrow 32 in FIG. 3, so that the roller 29 is urged outwardly in its orbital path.

Operation:

In a first step, the blank 11, for example of copper, is inserted in the die 2 and the die is closed so that the blank 11 is fixedly supported within the die.

If required, parts of the blank 11 which project beyond the bores 5 and 6 can be cut off so that the end faces of the pipe connecting regions 12 and 13 are in one common plane with faces of the die 2 which surround the bores 5, 6. Mandrels 19, 19' are inserted in the blank.

In a second step, the plungers 16 and 16' are moved in the direction of the arrows of FIG. 1, namely in the direction of the bore axes 9 and 10 axially toward the bores 5 and 6 until the support mandrels 19 and 19' have fully entered the pipe connecting portions 12 and 13 and are abutting each other with the abutment faces thereof. During entering the pipe connecting portions 12 and 13, the support mandrels 19 and 19' are guided by the pipe connecting portions 12 and 13.

Figure 2:
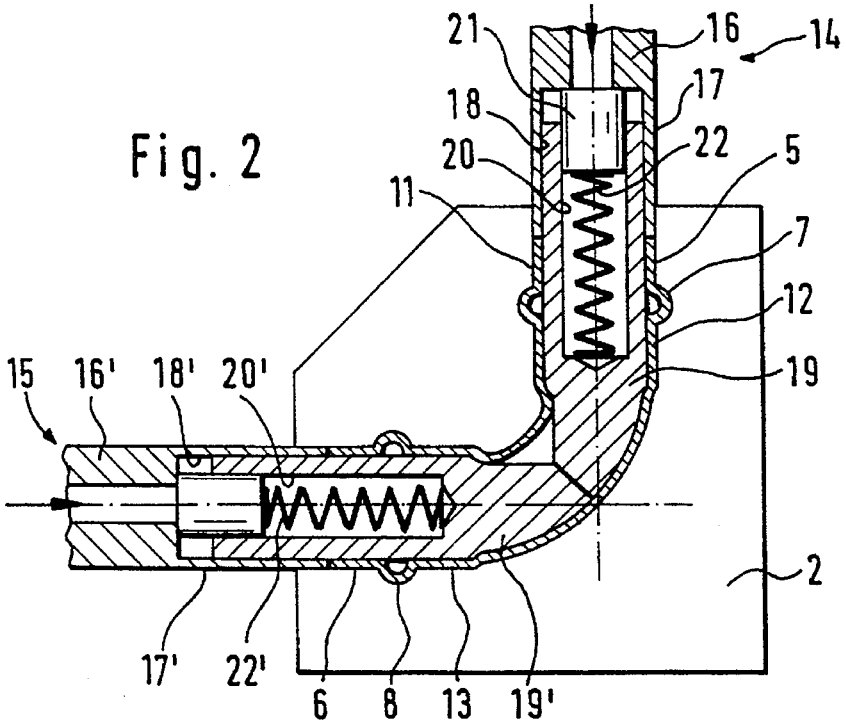
FIG. 2 is a schematic partial view of the apparatus shown in FIG. 1 during a second manufacturing step.

Without interrupting their movement, the plungers 16 and 16' are driven further toward the die 2. The upsetting sleeves 17 and 17' will abut the end faces of the pipe connecting portions 12 and 13 and push the pipe connecting portions 12 and 13 into the bores 5 and 6, respectively, as shown in FIG. 2. The upset sleeve 17, 17' slides on the respective support mandrel 19, 19', whereby the respective coil spring 22, 22' which is located in the blind bore 20, 20' is compressed. The upset sleeves 17 and 17' are laterally guided in the bores 5 and 6. The upset sleeves 17, 17' carry out, during upsetting, a defined stroke whereby the material of the respective pipe connecting portion 12, 13 bulges outwardly to form bulge 93 (FIG. 9) into the region of the annular groove 7, 8. This material will flow into the respective annular groove 7, 8. The wall thickness in the region of the resulting annular groove **13*a*** may increase slightly.

In a third step, and after finishing the upsetting stroke of the upsetting sleeve 17, 17', the plunger 16, 16' is retracted so that the support mandrel 19, 19' may be removed from the bore 5, 6. The region in front of the orifice of the bore 5, 6 is released and accessible.

During a next, that is, fourth step, the roll device 25, 26 is positioned in front of the bore 5 so that the roller 29, 29' is positioned directly in front of the orifice thereof. Then the roller 29 is moved into the bore 5, 6 by axial movement in the direction of arrow 30 until the roller 29, 29' is positioned exactly in the region of the annular groove 7, 8 and the interior of bulge 93 (FIG. 9). The roller 29 is rotated (arrow A) and also moved radially in the direction of arrow 32. The rotational axis of the roll 29, 29' is offset to the bore axis 9, 10, but parallel thereto. This forms a recess with low tolerances on the blank 11. The roller 29 moves in an orbital path which is concentric to the bore axis 9, 10. The recess **93*a*, formed by the roller 29, 29', will have low tolerances and the cross-sectional shape that is defined by the roller and groove 7, 8**.

The roller 29, 29' moves in an orbital, circular path with increasing diameter or, at least initially, rather in a spiral path. The roller 29, 29' is moved radially gradually and continuously until a stop is reached and the gap between the roller 29, 29' and the annular groove 7, 8 has a width which, preferably, equals the wall thickness of the remainder of the pipe connecting portion 12, 13. This rolling process is a non-cutting forming or shaping process which preserves the inner structure of the material and the durability of the compression or press pipe fitting.

The roller device 25, 26 is removed from the bore 5, 6 in a final step. The the die can be opened, by separating part 2 from its counterpart, and the pipe fitting is taken out. It will have an outwardly bulged portion 93 defining an inner circumferential recess **93*a***.

Figure 4:
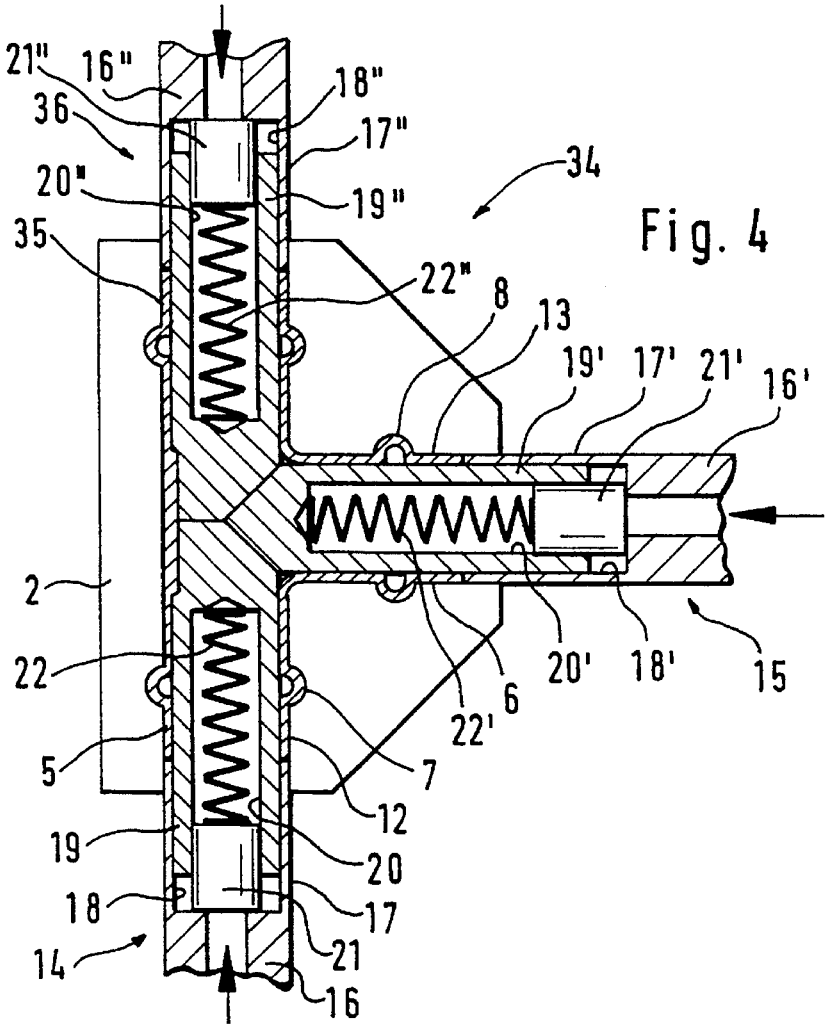
FIG. 4 is a schematic partial sectional view, broken away, of another embodiment of the apparatus for a T-fitting.

The method described above can be used for manufacturing of T-fittings if a modified apparatus is used. FIG. 4 shows an apparatus 34 in the finished, upsetting state. The apparatus 34 is largely identical to the apparatus 1 described above. Therefore, the same reference numerals are used for similar parts. The differences with respect to apparatus 1 are that the die has a further bore 35, which is aligned with the bore 5, and additionally with the bores 5, 6. A further upset device 36 is associated with the bore 35, which upset device is essentially identical to the upset devices 14 and 15. Therefore, the same reference numerals are used, with double prime notations. Furthermore, the support mandrels 19, 19', 19" of all three upset devices 14, 15, 36 are straight and provided with abutment faces abutting each other.

A third roller device, not shown, is provided.

Figure 5:
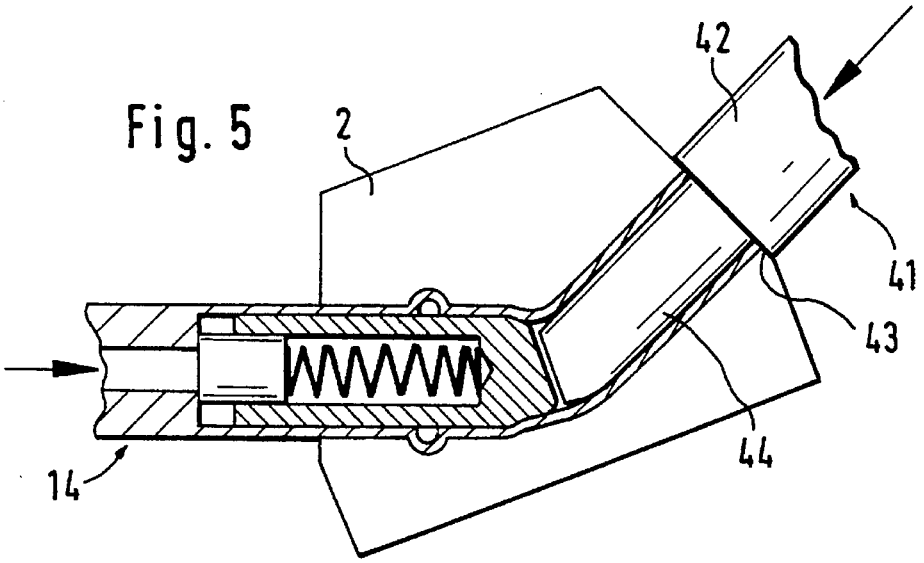
FIG. 5 is a schematic partial sectional view of an embodiment for production of a 45° elbow.

FIG. 5 shows that, in the example of a 45° elbow, the method according to the invention can also be used for production of an angled fitting having a compression connection portion only at one side. The apparatus 40 is used for manufacturing such fittings. The only differences between the apparatus 40 and the apparatus 1 are that the bores 5 and 6 do not define a right angle and that the bore 5 does not comprise an annular groove. Accordingly, an upset device is not provided for the bore 5 but only a supporting or holding device 41, formed by a cylindrical stepped mandrel 42, with an annular shoulder 43, which prevents the blank 11 from slipping out of the die. The portion of the blank 11 which is located within the bore 5 and which is not being upset is inwardly supported by a mandrel 44. The same arrangement can be used for a straight pipe connector.

The method is also applicable for the production of pressure pipe closure caps, adapters, or the like.

All the methods can be carried out automatically including inserting the blank 11 into the die 2 and removing the pipe fitting with its bulged portion 93 from the die part 2. Since only a few steps are necessary for manufacturing the pipe fitting which require not much time, many pipe fittings can be produced with excellent quality with the apparatus 1 in a short time.

The upsetting sleeve 17 has a plane end face which causes uniform pressure acting on the end face of the pipe connecting portion. The inner diameter of the upsetting sleeve 17 equals essentially the outer diameter of the support mandrel 19, and the outer diameter of the upsetting sleeve equals essentially the diameter of the opening 5 of the die. This design ensures that the whole end face of the pipe connecting portion is in contact with the upset sleeve. A gap between the upset sleeve 17 and the die and between the upset sleeve 17 and the support mandrel 19, respectively, is avoided so that material of the pipe fitting cannot flow between the upset sleeve 17 and the support mandrel 19 or between the upset sleeve 17 and the bore 5.

The support mandrel 19 and the upset sleeve 17 may have limited lateral play so that the guidance is provided to the blank 11 that is supported by the die 2. Small tolerances between the die, the upset sleeve and the support mandrel are allowable and do not lead to improper deformation of the blank 11.

Figure 6:
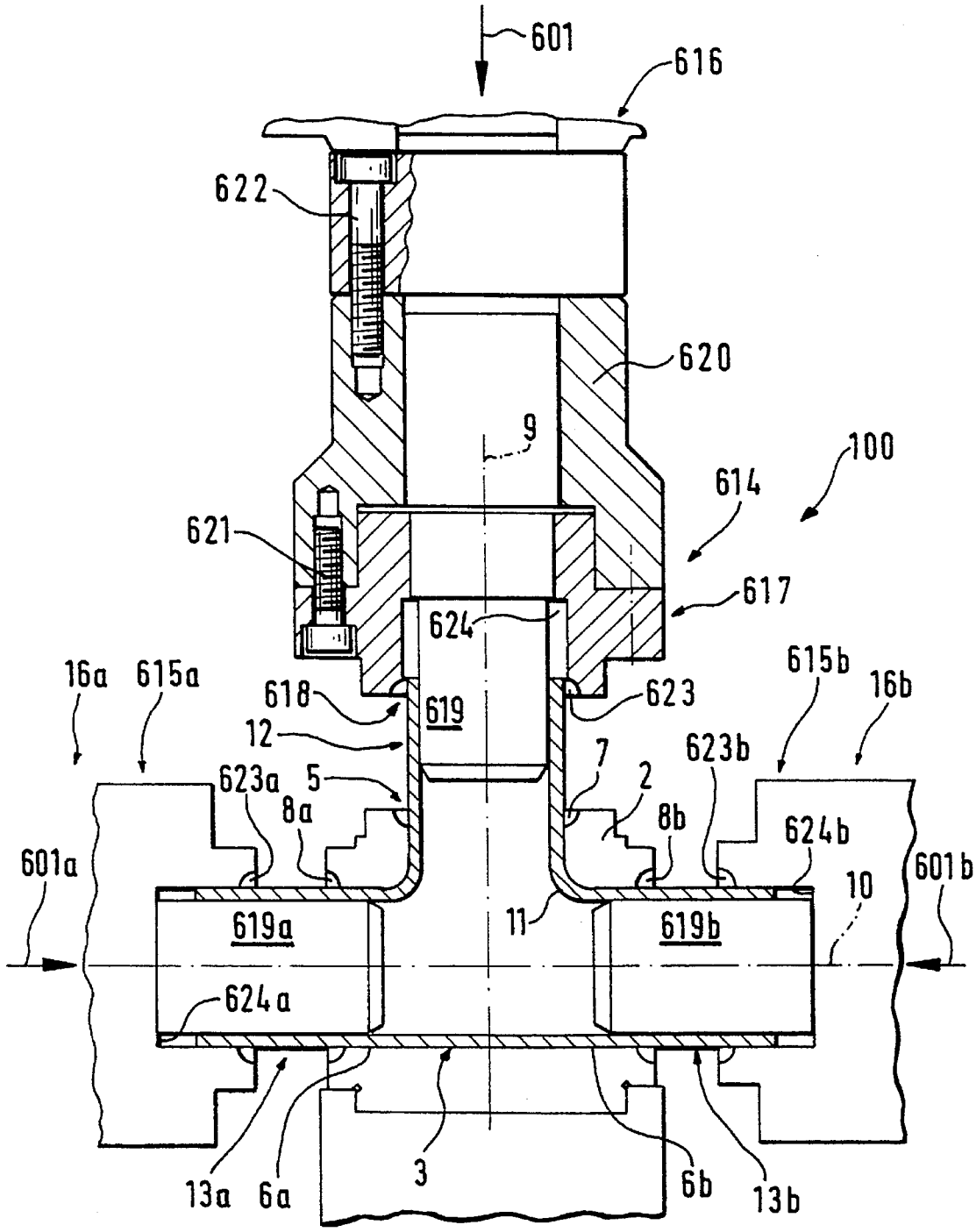
FIG. 6 is a schematic partial sectional view, broken away, of another embodiment of the apparatus.

FIG. 6 shows another apparatus, 100, for manufacturing of a T-shaped fitting having an outwardly bulged circumferential portion. Parts which are similar to parts and elements of the apparatus 1 described above carry the same reference numbers with added letters.

The cavity 3 of the die 2 is formed by the bore 5 which is intersected by the bore 6*a*, 6*b*. Every bore 5, 6*a*, 6*b* has at its orifice an annular recess 7, 8*a*, 8*b*, open at its edges, in the shape of a quarter circle. The recesses 7, 8*a*, 8*b* are open outwardly and are coaxial to the bore axis 9 and 10.

The blank 11 which is inserted into the cavity 3 projects with its pipe connecting portions 12, 13*a*, 13*b* out of the bores 5, 6*a*, 6*b*. The pipe connecting portions 12, 13*a*, 13*b* of the blank 11 are hollow cylindrical and have no bulge.

The upset devices 614, 615*a*, 615*b* are identical to each other so that hereinafter only the upset device 14 is described which description is to apply also at the upset devices 15*a*, 15*b*.

A matrix portion 617 is provided at the plunger 616 and faces the die 2. The matrix portion 617 serves as an upset member and comprises a central bore 618 which is aligned with the bore 5. The diameter of the bore 618 equals the diameter of the bore 5.

The support mandrel 619 is located in the opening 18 of the matrix portion 617 and arranged coaxially to the bore 5. The outer diameter of the support mandrel 619 equals the inner diameter of the blank 11. The matrix portion 617 and the support mandrel 619 as well are rigidly connected with the respective plungers 619, 619*a*, 619*b* by means of a connecting piece 620 and screws 621, 622. The plunger 616 is movable in an axial direction by force.

The opening 618 has an annular groove 623 of quarter-circle cross section at its orifice. The grooves 623 open toward the die 2 and are shaped so that they form, together with the annular groove 7, 8*a*, 8*b*, a smooth groove which has, in cross section, the shape of a half circle when the matrix portion 617 abuts the die 2.

An annular shoulder 624 is provided at the matrix portion 617 concentrically thereto and at a distance to the annular groove 623. The annular shoulder 624 forms a plane abutment face for the end face of the pipe connecting portion 12 of the blank 11. The distance between the annular shoulder 624 and the annular groove 623 is designed such that the portion of the blank 11 which enters the ring gap that is formed between the support mandrel 619 and the matrix portion 617, is being upset before the matrix portion 617 abuts the die.

Figure 7:
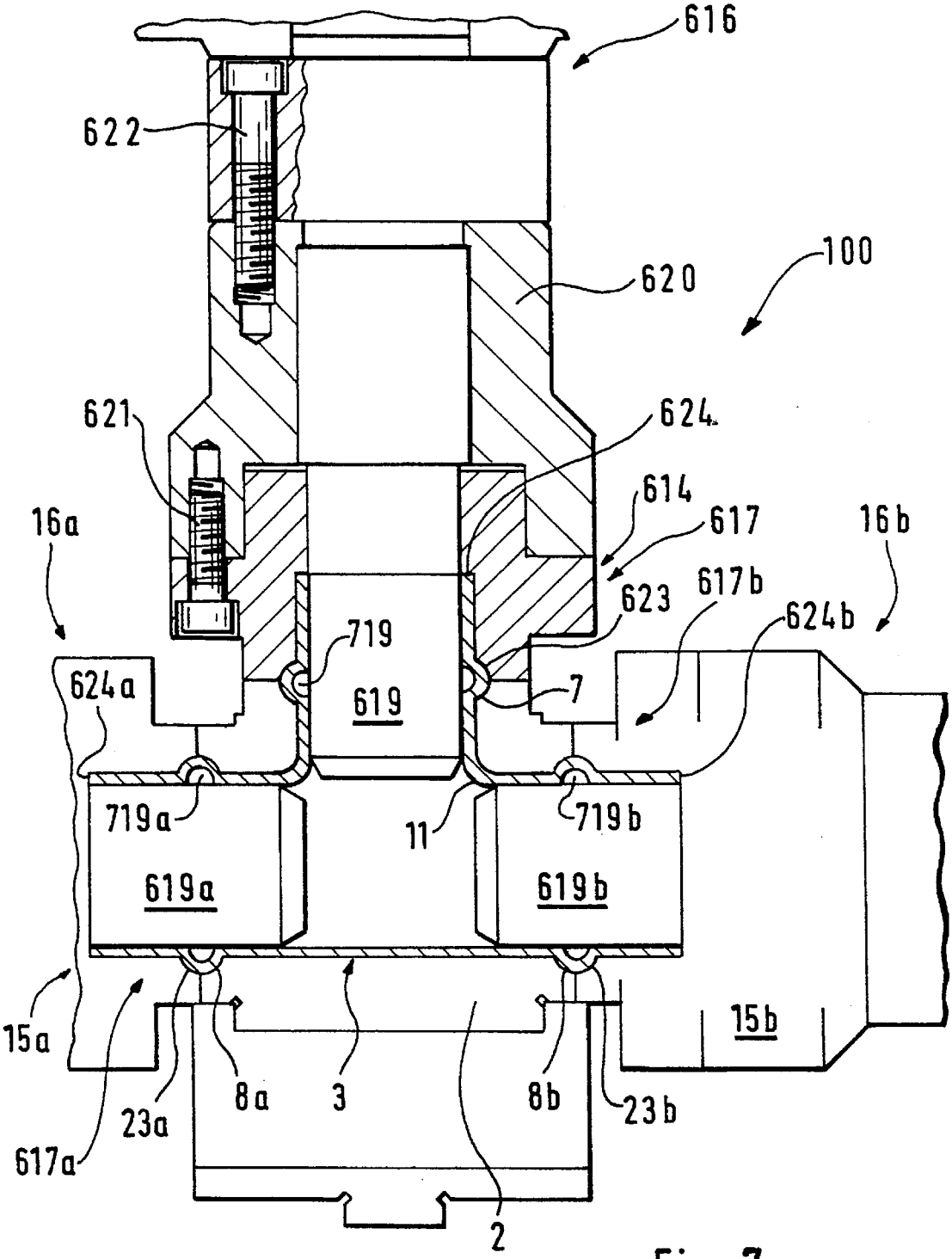
FIG. 7 is a view of the apparatus of FIG. 6, after performing a first major production step.

FIG. 7 illustrates the state of the apparatus after the upsetting steps are terminated. The bulges 719, 719*a*, 719*b*, formed in the joined recesses 7, 623; 8*a*, 623*a*; 8*b*, 623*b* are clearly seen.

Figure 8:
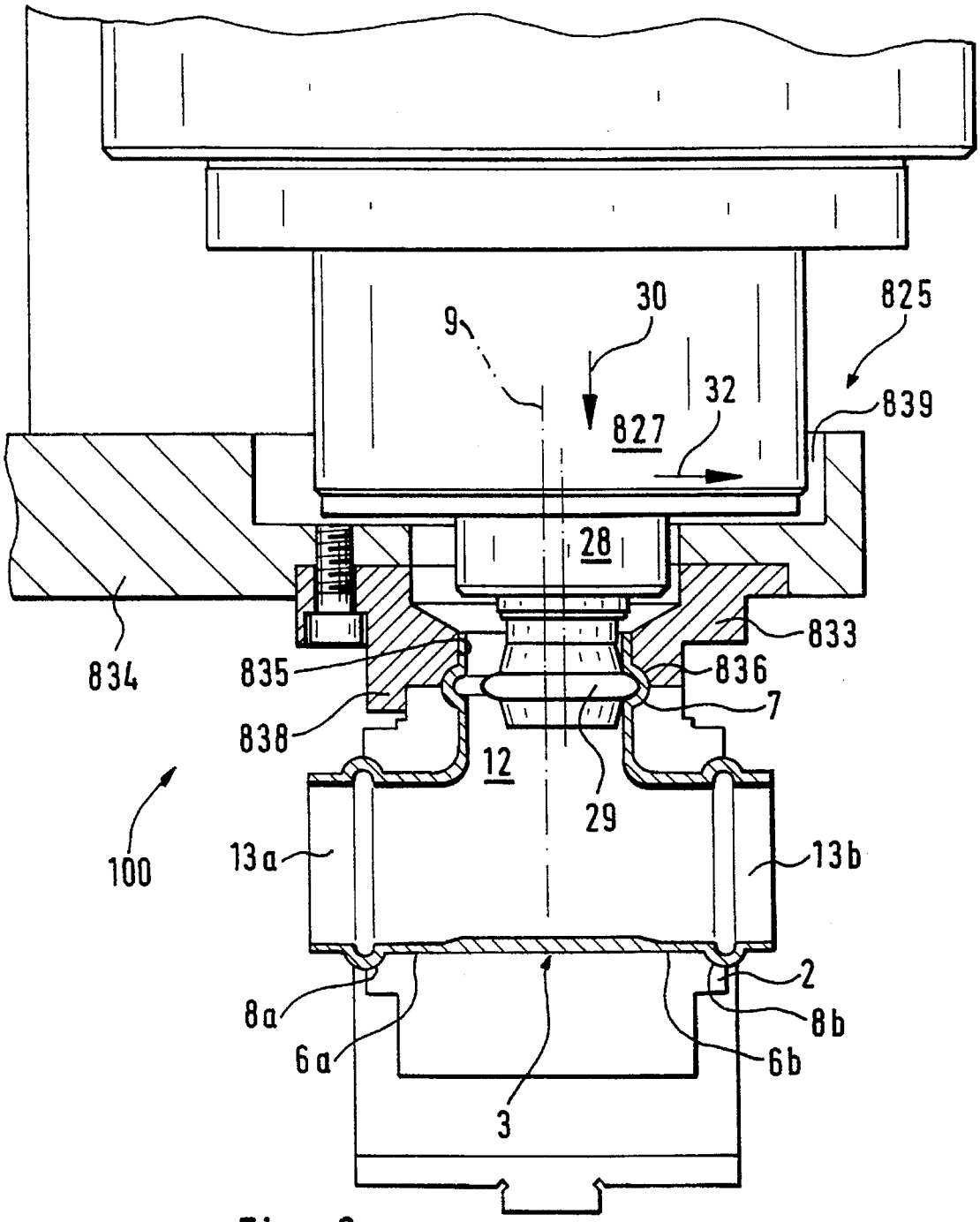
FIG. 8 is a fragmentary view of the apparatus of FIG. 6, performing a second major production step.

FIG. 8 shows the roller device 825 which is part of the apparatus 100 but which is not illustrated in FIG. 6. Roller devices are also provided for the bores 6*a*, 6*b* which roller devices have the same structure as the illustrated roller device 825 which is already described in connection with FIG. 3.

A matrix portion 833 is provided on a support structure 834, which is movable in the direction of the bore axis 9, for supporting the pipe connecting portion 12 during the rolling process. The matrix portion is provided with a through-bore 835 which is aligned with the bore 5. An annular groove 836 is provided on the matrix portion 833. The annular groove 836 faces the die 2 and forms together with the annular groove 7, for example, a bell-shaped or semi-circular annular groove. Groove 836 generally corresponds to the composite of recesses 7, 623.

Three protrusions 838 arranged in a 120° spacing, are provided on the matrix portion 833 for securely attaching the matrix portion 833 on the die, e.g. to part 2. The protrusions 838 project toward the die and are adapted to engage a cylindrical face provided on the die.

The through-bore 835 has a diameter that equals the diameter of the pipe connecting portion 12 at the side of the matrix portion 833 that faces the die and that increases at the other side of the matrix portion. A recess 839 is provided in the support structure 834 so that there is enough space for the base body 827. The matrix portion 833 and the die are coupled by the protrusions 838, only one of which is shown schematically at 840, and held together by the overall machine frame.

Further matrix portions are provided for supporting the pipe connecting portions 13, 13*b*.

Operation:

In a first step, the blank 11, which may be of copper, is inserted into the die part 2 and the mirror image part (not shown) is attached to part 2, so that the die is closed and the blank 11 is securely held and clamped within the die.

If desired, the pipe connecting portions 12, 13*a*, 13*b* are cut to a desired length since they are clamped in position.

In a second step, the plungers 616, 616*a*, 616*b* are moved in the direction of the arrows 601, 601*a*, 601*b* illustrated in FIG. 6, namely in the direction of the bore axes 9 and 10 axially toward the bores 5, 6*a*, 6*b* until the support mandrels 619, 619*a*, 619*b* enter the pipe connecting portions 12, 13*a*, 13*b*. The mandrels 619, 619*a*, 619*b* support with their cylinder faces especially that portion which will later be bulged outwardly.

In a next step, the plungers 616, 616*a*, 616*b* are moved toward the die 2 further, whereby the matrix portions 617, 617*a*, 617*b* abut with their annular shoulders 624, 624*a*, 624*b* the end faces of the pipe connecting portions 12, 13*a*, 13*b* and upset the pipe connecting portions 12, 13*a*, 13*b* so that the wall of the blank 11 will bulge outwardly. The upsetting process continues until the matrix portion 617, 617*a*, 617*b* abuts the die 2, see FIG. 7. The gap which is formed by the annular gaps 7 and 623 is, at the beginning of the upsetting process, open and, in this step, closes. A closed annular groove is formed by the finally closed gap into which the material of the wall of the pipe connecting portion 12, 13*a*, 13*b* flows. It is possible that the wall thickness in the region of the annular groove increases during upsetting.

In a subsequent step, the plunger 616, 616*a*, 616*b* is removed after the upsetting step is ended. The support mandrels 619, 619*a*, 619*b* are removed from the blank 11, and the region in front of the bores 5 and 6 is clear.

In a still further process step, the roller devices 825 and the matrix portion 833 are positioned in front of the bores 5, 6 so that the roller 29 is located directly in front of the orifice thereof. The support structure 34 with the matrix portion 833 approaches the die 2 so that the annular grooves 7, 836 are close to one another and define a closed channel-shaped groove. The protrusions 838 are resting at the cylinder face provided at the die 2 and support the matrix portion 833 in radial direction.

The roller 29 is moved into the bore 5 along the arrow 30 until the roller 829 is located in the region of the annular groove 7, 836. The rolling process of the circumferential groove of the pipe connecting portion 12 is performed in the same manner as described in connection with FIG. 3.

After finishing the inner circumferential recess of the outwardly bulged portions 719, 719*a*, 719*b* of the pipe connecting portion 12, the roller device 825 and the matrix portion 833 are withdrawn and the pipe fitting can be removed from the die 2.

The described process is also applicable for manufacturing of straight pipe connectors, connecting pieces, couplings, end caps, adapters, bent fittings and the like.

The methods described, and the apparatus to carry out the method, are particularly suitable for use with materials which deform easily, such as copper, soft brass or the like; merely rolling a circumferential groove into a sleeve is difficult to carry out with soft materials, such as copper for example, since the material has a tendency to escape from engagement with a roller, and the resulting groove and, at the outside, the resulting bulge, cannot be accurately reproduced in mass production. By pre-forming the bulge, and hence the inner groove, and subsequent rolling to size and shape, accurately dimensioned and shaped articles can be manufactured rapidly and at low cost, while maintaining wall dimensioning and tight tolerances in the resulting articles.

Various changes and modifications may be made, and any features described herein may be used with any of the others, within the scope of the inventive concept.

What is claimed is:

1. A method for producing, from a tubular blank, a circumferentially compressible pipe fitting of deformable material, optionally copper or steel, having an outwardly bulging bulge (93) defining an inner circumferential recess (93*a*), the blank (11) having at least one connecting portion (12, 13) of circular cross section, said method comprising the steps of receiving the blank (11) in a die (2) which surrounds the outer surface of at least one connecting portion of the blank;

said die being formed with an annular groove (7, 8) at the location of the desired bulge (93);

placing a support mandrel (19, 619) into the at least one connecting portion, which support mandrel abuts the blank at least on the inside of the at least one connecting portion (12, 13);

upsetting the blank (11) received in the die (2) in axial direction and flowing the material of the blank into the annular groove to form said outer circumferential bulge and said inner circumferential recess, while supporting the blank (11) within the die while upsetting the blank, said supporting step comprising supporting the pipe fitting at an annular region of the connecting portion (12, 13) at a location of the desired bulge (93), at least during said step of upsetting the blank (11);

removing the support mandrel (19, 619) from the upset blank (11); and shaping the inner circumferential recess (93*a*) from the inside of the blank in the region of the bulge (93).

2. Method according to claim 1, characterized by cutting the blank (11) at the connecting portion (12,13) to a predetermined length after inserting it into the die (2) and before inserting the support mandrel (19, 19').

3. Method according to claim 1, characterized in that the upsetting step comprises upsetting the blank (11) by a compression sleeve (17) subjected to a stroke of a length such, that after upsetting the wall thickness of the blank (11) is increased in the region of the circumferential bulge (93).

4. Method according to claim 1, characterized in that the shaping step comprises rolling the inner circumferential recess (93*a*) formed in the upsetting step by introducing a roller (29) into the connecting portion;

guiding the roller (29) in an orbital path; and biassing the roller (29) outwardly in a radial direction until the desired form of the inner circumferential recess and desired wall thickness of the material of the blank in the region of the recess (93*a*) are obtained.

5. Method according to claim 1, characterized in that the receiving step further comprises prior to the upsetting step, supporting and receiving the blank (11) within the die in an area which ends at the position of the groove (7, 8) in the die while leaving the blank (11) unsupported in an area beyond said groove with respect to an adjacent end of the blank (11).

6. Method according to claim 5, characterized in that the step of supporting the blank (11) during the upsetting step further comprises supporting the blank on its inside with a support mandrel (19); and further comprising the step of supporting the blank (11) on its outside with a movable matrix portion (17) by pushing, by force, an upset member and the matrix portion (17) onto the connecting portion (12, 13) of the blank (11).

7. Method according to claim 6, characterized in that the upsetting step includes upsetting the blank (11) exclusively in a region located between the die (2) and the movable matrix portion (17).

8. The method of claim 1, wherein said step of supporting the blank (11) within the die while upsetting the blank comprises axially supporting the blank in the die (2).

9. The method of claim 1, wherein said deformable material is copper.

10. A tool set or kit for making squeezable pipe fittings from a blank by carrying out the method of claim 1, comprising a die (2) formed with a cavity (3) for receiving a tubular blank (11), which cavity has an outer shape according to the desired pipe fitting and is formed with an inwardly extending groove (93*a*), said cavity having at least one reception opening (5, 6) for a connecting portion (12, 13) of the pipe fitting;

a support mandrel (19), having an outer dimension to fit within the interior of the tubular pipe fitting, said support mandrel being coaxially movable into, and removable out from the opening (5, 6) of the die;

an upset member (17) that is movable toward the opening (5, 6) of the die (2) by force, and engageable with an end of the connecting portion of the tubular blank (11), for upsetting the connecting portion (12, 13) of the blank and forcing material of the blank into the groove (7, 8), and thereby form the bulge (93) on the blank and the circumferential recess (93*a*) therein; and at least one roll device (25) movable into and removable from the connecting, portion (12, 13) of the blank and movable inside the connecting portion (12, 13) along a path eccentric with respect to the opening (5, 6) and the circumferential recess (93*a*) within the blank, and biassed outwardly in a radial direction for shaping the inner circumferential recess (93*a*) on the inside of the upset blank in the region of the bulge.

11. The tool set or kit of claim 10, including means for positively guiding the support mandrel (19) along its longitudinal directional path within the blank.

12. The tool set or kit of claim 10, characterized in that the upset member (17) includes a planar annular abutment face which faces the die and is engageable with the blank (11).

13. The tool set or kit of claim 10, characterized in that the die encloses the inserted blank (11) and is formed with more than one annular groove (7) located at respectively different positions within the cavity (3) of the die (2) to receive a respective bulge (93) formed in the blank upon movement of the upset member (17).

14. The tool set or kit of claim 10, characterized in that the upset member (17) is formed with a bore, in which the support mandrel (19) is guided, and having an outer diameter that is slightly smaller than the diameter of the opening (5, 6) of the cavity (3) of the die (2) so that the upset member (17) can enter the opening (5, 6).

15. The tool set or kit of claim 10, characterized in that the die (2) includes a die member which, is formed with the opening (5, 6) and the orifice of the opening is formed with a portion of the annular groove (7); and that the upset member (17) comprises a die matrix portion which is provided with another portion (23) of the annular groove to complete the die (2), said die matrix portion fitting against said die member, and, when joined next to each other, forming the complete groove (7).

16. The tool set or kit of claim 15, characterized in that the die matrix portion (17) is provided with an annular abutment surface (24) forming an engagement surface.

17. The tool set or kit of claim 15, characterized in that the portion of the annular groove (7) of the die member and the portion of the annular groove of the die matrix portion (17) have, when the die matrix portion (17) abuts the die member, a longitudinal sectional shape which coincides with the desired outer shape of the bulge (93).

18. The tool set or kit of claim 15, characterized in that the support mandrel (19) and the die matrix portion (17) are rigidly connected with each other.

19. The tool set or kit of claim 15, characterized in that the roller device (825) includes a matrix element (833) engageable over, and supporting the fitting during the rolling step; and coupling means (838) are provided for coupling and securing the matrix element (33) on the die member.

* * * * *